US005092299A

United States Patent [19]

Muntean et al.

[11] Patent Number: 5,092,299

[45] Date of Patent: Mar. 3, 1992

[54] AIR FUEL CONTROL FOR A PT FUEL SYSTEM

[75] Inventors: George L. Muntean, Columbus; Kevin W. Westerson, Nashville; Perry J. Donnelly, Columbus, all of Ind.

[73] Assignee: Cummins Engine Company, Inc., Columbus, Ind.

[21] Appl. No.: 620,199

[22] Filed: Nov. 30, 1990

[51] Int. Cl.[5] ..... F02M 41/00

[52] U.S. Cl. ..... 123/462; 123/383; 123/381

[58] Field of Search ..... 123/462, 460, 457, 383, 123/382, 390, 381

[56] References Cited

U.S. PATENT DOCUMENTS

| | | | |
|---|---|---|---|
| 2,790,433 | 4/1957 | Catford | 123/460 |
| 2,902,016 | 9/1959 | Powell | 123/462 |
| 3,077,873 | 2/1963 | Parks | 123/382 |
| 3,795,233 | 3/1974 | Crews et al. . | |
| 4,187,817 | 2/1980 | Wilson et al. . | |
| 4,248,188 | 2/1981 | Wilson et al. . | |
| 4,462,372 | 7/1984 | Jackson | 123/462 |
| 4,469,070 | 9/1984 | Rassey | 123/462 |
| 4,664,084 | 5/1987 | Wheelock | 123/462 |
| 4,869,219 | 9/1989 | Bremmer et al. . | |

*Primary Examiner*—Carl Stuart Miller

*Attorney, Agent, or Firm*—Sixbey, Friedman, Leedom & Ferguson

[57] ABSTRACT

An air fuel control system for an internal combustion engine is disclosed. The control system includes an air pressure responsive device for modulating mechanically the flow of fuel into the engine in response to the pressure of air within the intake manifold. The pressure-responsive device includes first and second chambers, separated by a diaphragm being attached to a piston, with the first chamber which is connected to the intake manifold by an air line. The air fuel control system further includes a fuel metering device for controlling the flow of fuel into the air-fuel control in response to intake manifold air pressure including a barrel and plunger assembly with the barrel inlet port being specifically configured to accommodate both the no-air and transition-curve fuel rail pressures. The barrel profile is designed to meter fuel quickly and precisely in response to changes in manifold air pressure. Displacement of the plunger initially uncovers a small inlet port in the barrel which provides for viscosity insensitivity for aiding in cold starts and cold accelerations. Continued displacement of the plunger uncovers the lead of a transition region which provides for ease in the calibration of the air fuel control. A further region of transition region is next uncovered which permits acceleration with reduced acceleration smoke, noise and emissions while optimizing transient engine response. With an increase in air pressure from the manifold, a fourth region is uncovered which represents a driver feel of the acceleration without emission penalties and finally, once the plunger has reached the larger input port, a sharp inflection is realized wherein full fuel flow is permitted.

19 Claims, 3 Drawing Sheets

AIR FUEL CONTROL FOR A PT FUEL SYSTEM

TECHNICAL FIELD OF THE INVENTION

The present invention relates generally to air fuel control systems for internal combustion engines and specifically to a dual spring air fuel control having a port shaped barrel for a compression ignition type internal combustion engine wherein the quantity of fuel supplied to respective fuel injectors of the engine cylinders is varied in response to intake manifold air pressure.

BACKGROUND OF THE INVENTION

Regulation of the air and fuel mixture supplied to an internal combustion engine, particularly an engine of the compression ignition type, has received widespread attention. Unless a satisfactory air/fuel ratio is achieved in the engine cylinders, engine operation will be adversely affected and fuel economy will be reduced. Moreover, accurate regulation of the air and fuel mixture will be necessary in order to achieve the stringent Environmental Protection Agency (EPA) emissions standards for the years 1991 and 1994. Proper regulation of the air/fuel mixture can eliminate or reduce substantially undesirable emission components from the engine exhaust. If air and fuel are supplied to the cylinders in a carefully controlled ratio which will allow complete combustion to occur under all operating conditions, expensive devices for removing exhaust emissions to achieve acceptable vehicle emission control may be entirely eliminated. In addition, efficient and economic engine operation will be realized as well.

Fuel systems for internal combustion engines wherein the fuel supplied to the engine is controlled in response to intake manifold pressure are well known. Many such systems include a source of fuel under pressure, e.g., a fuel pump, and a mechanism for regulating the pressure of the fuel supplied to an injector located at each cylinder. To achieve optimum air/fuel ratios under all operating conditions, highly sophisticated refinements have been made in these basic components to permit a carefully scheduled pressure output as a function of operator demand and engine speed. U.S. Pat. Nos. 4,187,817 and 4,248,188 to Wilson et al. are illustrative of such systems. The air/fuel control systems described in these patents mechanically modulate the flow of fuel into the engine in response to the pressure of the air in the intake manifold, which varies from a "no-air" condition below the rated pressure level to the full rated pressure. Both systems employ a diaphragm or flexible bellows operator for a fuel flow modulating valve responsive to engine intake manifold air pressure as sensed through an air line connecting the diaphragm operator with the intake manifold. The diaphragm is biased by a single spring selected and calibrated to provide modulation of the valve restriction to vary the fuel pressure in response to intake manifold pressure whereby the optimum air/fuel ratio can be maintained over a broad range of operating conditions. A drain line is additionally included in these systems to provide a fluid connection between the air fuel control mechanism and the engine fuel tank.

The air fuel control system disclosed in U.S. Pat. No. 4,187,817 further includes a flow restrictor in the air line to prevent engine fuel tank pressurization and reverse fuel flow into the engine's tank pressurization and reverse fuel flow into the engine's intake manifold in the event of a rupture of the diaphragm operator. The air fuel control system of U.S. Pat. No. 4,248,188 includes, in addition, an attenuator assembly which attenuates the transient response of the diaphragm operator by causing fuel to be supplied to a control chamber at a rate which is greater than that at which fuel is discharged from the chamber. While these air fuel control systems generally achieve an adequate air/fuel ratio, very precisely controlled metering of fuel is difficult to achieve and, hence, an optimum air/fuel ratio is not always realized for all engine operating conditions. Moreover, the variations in back pressure which have been characteristic of these prior art air fuel controls have caused air fuel control delay variations and, consequently, response problems. Further, engines intended for marine applications have not been able to employ the kind of drain line disclosed by the prior art air fuel controls. In the event of a diaphragm failure in a prior art air fuel control of the kind described in the aforementioned patents in a marine engine, fuel would tend to collect in the bilge.

Other air fuel control systems which employ diaphragm operators are also known in the prior art. For example, U.S. Pat. No. 3,795,233 to Crews et al. discloses a control device for a super-charged engine having a governor means connected to a fuel-adjusting member and a supercharger which supplies air to the engine through an intake manifold. Three spring members are employed in this system to balance forces on the diaphragm when there is no pressure in the control system chamber on the intake manifold side of the diaphragm. This system is responsive to both intake air pressure and engine oil pressure to override the governor means. However, the system described in this patent does not include a fuel flow modulating valve, but employs a mechanical linkage to vary the fuel supplied to the engine upstream of the throttle.

Moreover, none of the air fuel control devices disclosed by the prior art is completely tamper-resistant. Improper tampering with an internal combustion engine fuel supply adversely affects both fuel economy and long term engine durability. Fuel systems of the type described in the aforementioned patents generally include a drain line to the fuel tank for returning fuel which is not injected into the engine cylinders or which is bled from the gear pump section of the fuel pump and an adjustable air screw in the fuel pump. It is widely known that the short terms power output of engines equipped with such fuel system can be increased by clamping off this drain line and opening the air screw. However, the effects of such unauthorized modification can be extremely adverse, and may result in a reduction in fuel economy and shortened engine life. In addition, such unauthorized adjustments may cause engine emissions to vary from those achieved by the air fuel control settings set by the engine manufacturer so that the engine does not comply with emissions standards established by the EPA.

U.S. Pat. No. 4,869,219 issued to Brimmer et al. and assigned to the assignee of the present invention, the disclosure of which is incorporated herein by reference, discloses a dual spring air fuel control for PT fuel systems which overcomes a number of the shortcomings associated with the above noted prior art. Disclosed therein is a dual spring controlled air fuel control for a compression ignition type internal combustion engine, wherein fuel is supplied to the engine cylinders in response to the pressure of the air in the intake manifold.

The stem valve, which includes a plunger and a barrel, operates to meter a controlled amount of fuel to the engine fuel supply system as the intake air pressure increases and reduces this metered flow as the intake air pressure decreases. Such is carried out by the cooperation of the plunger with the fuel input passage formed in the barrel. In one embodiment, this fuel input passage includes a large and small diameter inlet port which are connected to one another by a narrow channel such that when viewed from above the fuel inlet ports and the connecting channel assume a keyhole-like configuration. However, with this configuration, there is little viscosity sensitivity at no-air, there is no variation in the channel opening to account for increasing smoke, emissions, noise and response optimization, nor is there any region of the channel which provides for a uniform but quickly increasing bore diameter to provide driver feel once sufficient air is provided by the turbocharger to enable efficient combustion.

The prior art, therefore, fails to disclose an air fuel control for an internal combustion engine which responds quickly to meter a controlled, optimum amount of fuel in response to intake manifold air pressure, which is capable of controlling smoke, noise, emissions and provide transient engine response optimization during acceleration and which provides driver feel once sufficient air is provided by the turbocharger to enable efficient combustion.

SUMMARY OF THE INVENTION

It is a primary object of the present invention, therefore, to overcome the disadvantages of the prior art.

It is another object of the present invention to provide an air fuel control for an internal combustion engine which responds quickly to meter a controlled amount of fuel in response to changing intake manifold air pressure.

It is another object of the present invention to provide a barrel and plunger assembly for an air fuel control which includes internal pressure differential controlling means for substantially eliminating fuel leakage from the barrel and plunger assembly.

It is yet another object of the present invention to provide an air fuel control system for an internal combustion engine which cannot be adjusted on the engine, but must be removed from the engine before adjustment can be made.

It is still another object of the present invention to provide an air fuel control system for an internal combustion engine which internally vents excess fuel into the engine crankcase and, therefore, does not require a drain line connecting the air fuel control system and the engine fuel tank.

A further object of the present invention is to provide an air fuel control system for an internal combustion engine which reduces viscosity sensitivity at no-air and includes a low gain area of constant bore diameter to allow for ease in calibrating the air fuel control.

Yet another object of the present invention is to provide an air fuel control system having an inlet port configuration which includes a section of slowly increasing bore diameter for controlling smoke, noise and emissions and which optimizes transient engine response during acceleration.

Still, a further object of the present invention is to provide an air fuel control system which includes an inlet port having a uniform but quickly increasing bore diameter to provide driver feel once sufficient air is provided by the turbocharger to enable efficient combustion.

In accordance with the aforesaid objects, an air fuel control system for an internal combustion engine which is operationally controlled by the pressure of fuel supplied to the engine from a fuel source and which has an intake manifold for supplying air to the engine is provided comprising air pressure responsive means for modulating mechanically the flow of fuel into the engine in response to the pressure of air within the intake manifold including a cavity, and an air line connecting the cavity with the intake manifold. The pressure-responsive actuating means transforms changes in intake manifold pressure into mechanical movement to operate the pressure-responsive actuating means. The pressure-responsive actuating means includes first and second chambers, separated by the diaphragm attached to a piston, and the first chamber is connected to the intake manifold by the air line. A first main spring biases the piston toward the first chamber, and a second bias spring biases the piston away from the first chamber. The pressure-responsive actuating means further includes fuel metering means for controlling the flow of fuel into the air-fuel control in response to intake manifold air pressure. The fuel metering means includes a barrel and plunger assembly with the barrel inlet port being specifically configured to accommodate both the no-air and transition-curve fuel rail pressures. The barrel profile is designed to meter fuel quickly and precisely in response to changes in manifold air pressure and, in addition, the barrel and plunger are fitted together with a class fit to minimize the leakage of excess fuel. Internal pressure differential controlling means are additionally provided within the plunger to eliminate substantially fuel leakage.

Displacement of the plunger initially uncovers a small inlet port in the barrel which provides for viscosity insensitivity for aiding in cold starts and cold accelerations. Continued displacement of the plunger uncovers the lead of a transition region which provides for ease in the calibration of the air fuel control. A further region of transition region is next uncovered which permits acceleration with reduced acceleration smoke, noise and emissions while optimizing transient engine response. With an increase in air pressure from the manifold, a fourth region is uncovered which represents a driver feel of the acceleration without emission penalties and finally, once the plunger has reached the larger input port, a sharp inflection is realized wherein full fuel flow is permitted Still other and more specific objects of this invention can be appreciated by consideration of the following Brief Description of the Drawings and the following description of the Detailed Description of the Invention.

DETAILED DESCRIPTION OF THE INVENTION

The fuel system in which the subject invention is to be employed is that of an internal combustion engine of the compression ignition type wherein the engine is controlled by the pressure of the fuel supplied thereto by the fuel supply system. This type of engine includes a plurality of cylinders into which fuel is injected by fuel injectors which are synchronously actuated with the movement of the engine pistons. The quantity of fuel actually injected into each cylinder depends upon the pressure of the fuel supplied to a common rail or line by the fuel supply system. The pressure of this fuel, in turn, is determined by a scheduled pressure output as a function of operator demand, generally indicated by the throttle position, and as a function of engine speed. The kind of fuel supply system for which the present invention is ideally suited is described in U.S. Pat. Nos. 4,187,817 and 4,248,188, assigned to the same assignee as the present invention, the disclosures of which are hereby incorporated herein by reference.

The achievement of an optimum and accurate air fuel ratio within each engine cylinder is particularly important in turbocharged engines where the intake pressure may fall below the rated pressure under certain operating conditions. Consequently, the capability for mechanically modulating and controlling the flow of fuel into the engine in response to the pressure of the air in the intake manifold is essential to efficient engine operation. Moreover, it is also essential to the achievement of efficient engine operation and acceptable exhaust emission levels to maintain the air/fuel ratio within a predetermined operating range which cannot be adjusted while the air fuel control is mounted on the engine, but requires removal of the air fuel control from the engine prior to adjustment.

Figure 1:
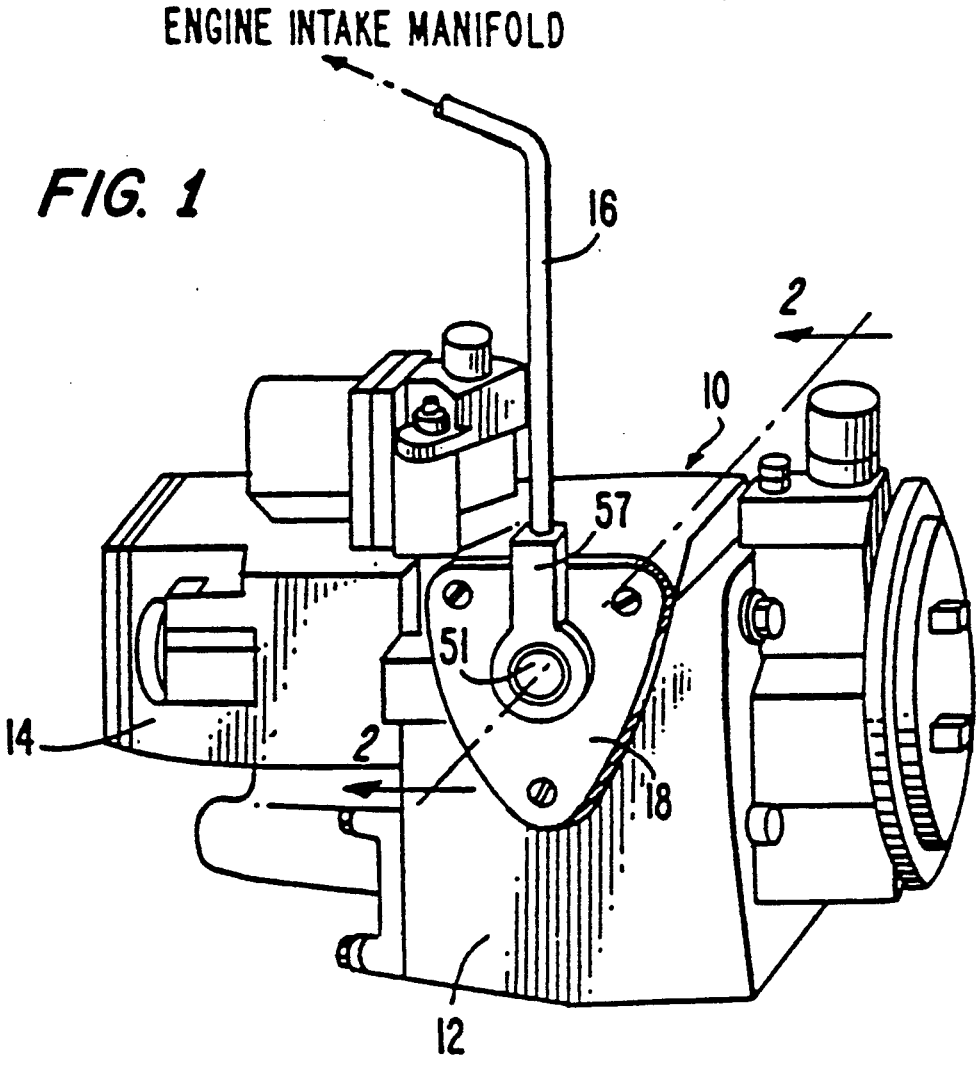
FIG. 1 is a perspective view of a portion of an engine fuel supply system illustrating an air fuel control for modulating fuel flow to the engine in response to the air pressure within the intake manifold of the engine.

Referring to the drawings, FIG. 1 illustrates an air fuel control 10 which may be effectively employed to achieve and maintain a proper supply of fuel to the cylinders in response to intake manifold pressure. Related portions of the engine fuel supply system are additionally illustrated in FIG. 1. These include the fuel pump 12 and the gear pump 14. An air line 16 provides a direct connection between the engine intake manifold (not shown) and the air fuel control interior through cover plate 18.

Figure 2:
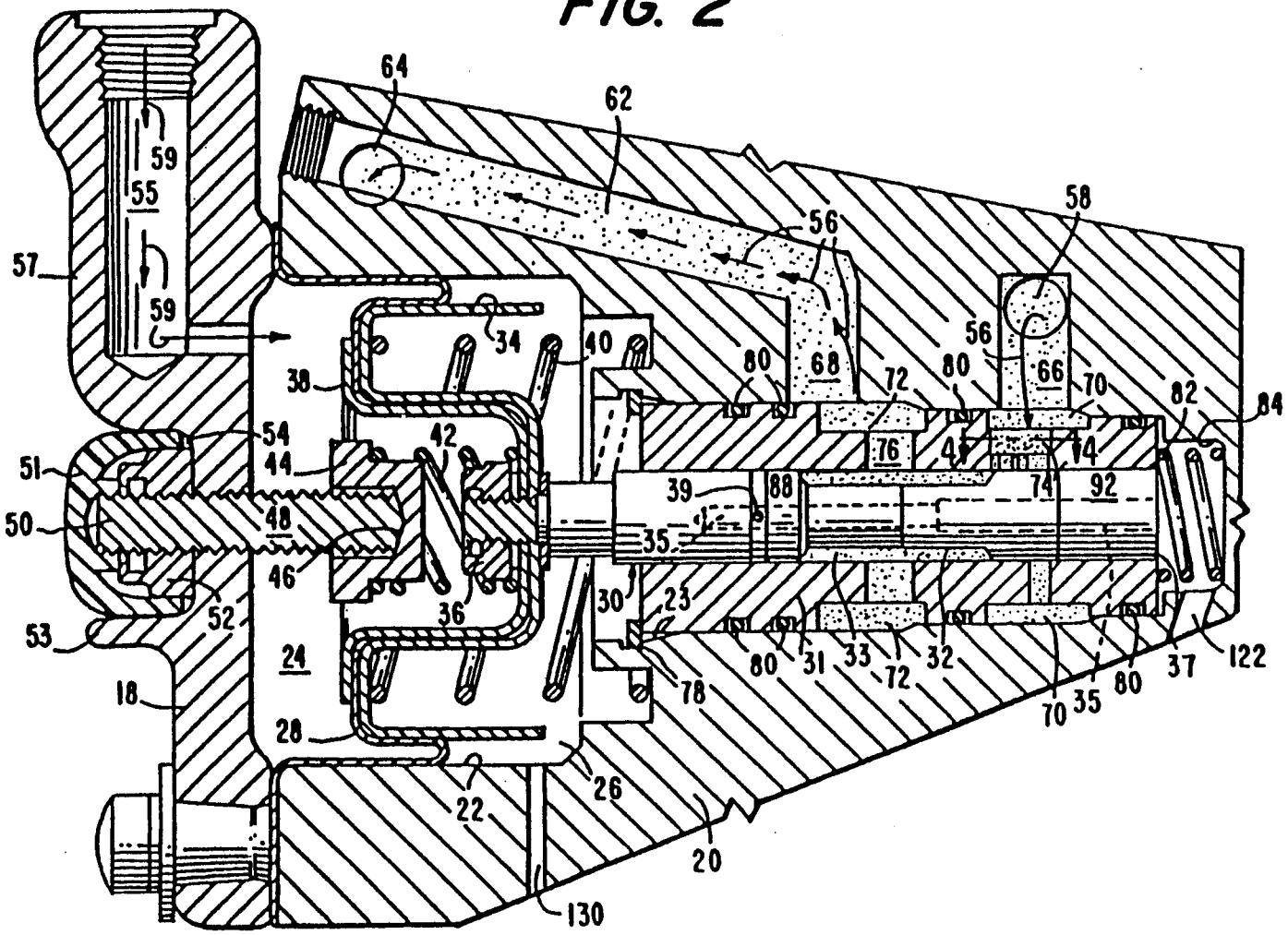
FIG. 2 is a cross-sectional view of the air fuel control in accordance with the present invention in the no air condition taken along line 2—2 of FIG. 1.

In order to understand fully the subject invention, it is necessary to describe the operation of the air fuel control 10 and the manner by which it operates to modulate the flow of fuel to an internal combustion engine in response to the pressure within the intake manifold of the engine. Reference is made to FIG. 2 for this purpose. FIG. 2 illustrates a cross-sectional view of the air fuel control 10 taken along line 2—2 of FIG. 1. FIG. 2 illustrates the condition of the air fuel control when the pressure within the intake manifold is below the rated pressure level. A "no-air" condition results when the intake manifold pressure is zero or when the air supply line to the air fuel control is disconnected.

The air fuel control 10 includes a housing 20 containing a control chamber 22 subdivided into a first chamber 24 and a second chamber 26 by a flexible bellows member or diaphragm 28. The diaphragm 28 is operationally connected to one end of a stem valve 30 provided with plunger 32. The opposite end of the stem 30 is attached to a piston 34 by a nut 36. Nut 36 is also employed to removably secure the diaphragm retainer 38 which engages the interior edge of the diaphragm 28 on the piston 34. The exterior edge of diaphragm 28 is engaged by the air fuel control cover 18.

The piston 34 and diaphragm retainer 38 are preferably formed from steel stampings or the like, and the flexible bellows member or diaphragm 28 should be formed of a material capable of withstanding a pressure differential of at least 150 pounds per square inch. A diaphragm constructed from a fabric coated on both sides has been found to function well for this purpose. An exemplary material for the diaphragm 28 which is capable of withstanding this pressure differential is a 100% Dacron fabric coated on both sides with an elastomer, such as 70% fluorosilicone/30% silicone rubber with fillers. However, other, equivalent materials may be employed as well.

A set of dual, oppositely biased springs are provided in the control chamber 22 to bias the piston 34 either toward the air fuel control cover 18 when the intake manifold pressure is below the rated level or away from the cover 18 as the intake manifold pressure increases. The main spring 40 is located within the second chamber 26 and is biased toward the cover 18 to contact piston 34 so that the piston is urged toward the cover 18. A second spring, bias spring 42 is biased away from the cover 18 and, thus, exerts a force opposite to that of spring 40 on piston 34. The bias spring 42 is positioned around nut 36 so that one end contacts the diaphragm retainer 38. The opposite end of bias spring 42 engages a bias spring retainer element 44, which is held in place within chamber 24 by the interior end 46 of a threaded adjusting screw 48. The opposite end 50 of adjusting screw 48 extends outwardly from the control chamber 22 through the cover 18, to engage a correspondingly threaded nut 52 located on the exterior of the cover 18. The longitudinal expansion of bias spring 42 can thus be controlled by adjusting the distance which the bias spring adjusting screw 48 extends into the control chamber. The operational significance of this feature of the air control will be explained in more detail hereinbelow.

The air fuel control cover 18 includes an air supply passage 55 formed within a thickened portion 57 of the cover 18 which connects directly to line 16 and, therefore, to the engine intake manifold. Air from the intake manifold may enter chamber 24 of the air fuel control along the path shown by arrows 59.

The air fuel control cover 18 is additionally provided with a central recess 54 defined between the cover thickened portion 57 and a peripheral boss 53 where end 50 of the adjusting screw 48 exits the cover to engage nut 52. Because the air fuel control cover is located immediately adjacent to the engine block, access to the adjusting screw is blocked when the air fuel control is mounted on the engine. Consequently, adjustment of the "no-air" position of the bias spring and, therefore, the piston and associated structures can only be made after the air fuel control is removed from the engine and mounted on a fuel pump test stand. Unauthorized tampering with the air fuel control "no-air" setting while the air fuel control is mounted in place on the engine, therefore, is virtually impossible with the present invention.

Additional tamper proofing may also be provided in the form of a cap 51 which fits securely within recess 54 over the end 50 of adjusting screw 48 and over nut 52 between the air fuel control cover thickened portion 57 and peripheral boss 53 to cover both of these structures completely. A cap 51 having the cross-sectional configuration shown in FIG. 2 is preferred for this purpose. However, other structures which serve the same function may also be employed to prevent the unauthorized adjustment of screw 48 after the air fuel control has been set by the manufacturer and mounted in place on the engine.

As noted hereinabove, the stem valve 30 is provided with a plunger 32 slidably received within a central bore 33 in a barrel 31 mounted in cavity 23 in the interior of the air fuel control housing 20. The profile of the plunger and barrel have been specifically designed as discussed below with reference to FIGS. 3 and 4 to accommodate both the "no-air" and "transition curve" pressure encountered in the fuel supply rail.

The plunger 32 includes a central longitudinal channel 35, shown in dashed lines in FIG. 2, which extends from the tip 37 of the plunger toward the second chamber 26. A vent 39 provides fluid communication between channel 35 and the barrel central bore 33 to minimize fuel leakage from the barrel as will be explained in detail hereinbelow.

When the air fuel control stem valve 30 is in the position shown in FIG. 2, the fuel path through the air fuel control is illustrated generally by arrows 56 which show fuel entering the control through an inlet port 58 and then through an outlet passage 62 to exit outlet port 64. An inlet bypass passage 66 is formed in housing 20 between the inlet port 58 and the cavity 23 which receives the barrel 31. An outlet bypass passage 68 is also formed in housing 20 to direct fuel away from the barrel 34. Inlet passage 66 and outlet passage 68 are aligned with first and second annular grooves 70 and 72, respectively, formed in the exterior surface of the barrel. Grooves 70 and 72 communicate with a barrel fuel inlet passage 74 and a barrel fuel outlet passage 76, respectively.

The barrel 31 is seated within cavity 23 in the air fuel control housing 20 by an annular retaining ring 78 and by a plurality of annular O-ring type seals 80 located at spaced intervals along the exterior surface of the barrel. At least four O-rings of this type are preferred to provide a reliable, substantially leak-proof seal around the barrel 31. A compression spring 82 is further provided within a recess 84 in the housing 20 and biases the barrel toward the retaining ring 78 to hold the barrel and plunger assembly securely in place within the air fuel control housing.

When the plunger 32 is in the position shown in FIG. 2, fuel flow through the barrel 34 from inlet passage 66 to outlet passage 68 is blocked by the plunger. This situation occurs when the pressure of the air in the intake manifold is well below its rated value, or at a "no-air" or zero pressure condition. In this condition, the main spring 40 biases the piston 34 and, hence, the stem valve 30 and plunger 32 toward the air fuel control cover 18 so that a small fuel flow area is created between the barrel and the plunger. This causes the "no-air" fuel to flow into the central bore 33 and through fuel passage 76 in the barrel. The bias spring 42 is biased toward the spring retaining element 44 by the piston as shown in FIG. 2 and compressed to a degree which depends upon the location of the retaining element 44. As discussed hereinabove, this location may be adjusted by turning the threaded adjusting screw 48 and is set prior to installation of the air fuel control on the engine to control the extent of the longitudinal movement of the plunger 32 in response to the intake air pressure exerted on the diaphragm 28.

As the pressure of the air in the intake manifold increases, air will enter the air fuel control through the passage 55 and begin to fill the first chamber 24. As the pressure of the air in first chamber 24 increases, pressure will be exerted against the diaphragm 28, the diaphragm retainer 38 and the piston 34, causing the main spring to be compressed and the stem valve 30 to move away from the air fuel control cover 18. The bias spring 42, which was previously compressed, will simultaneously begin to expand and a clearance within this range is less than about 1.0 cc/hr., which is within the same range as the fuel leakage past a fuel injector and its associated barrel.

Figure 3:
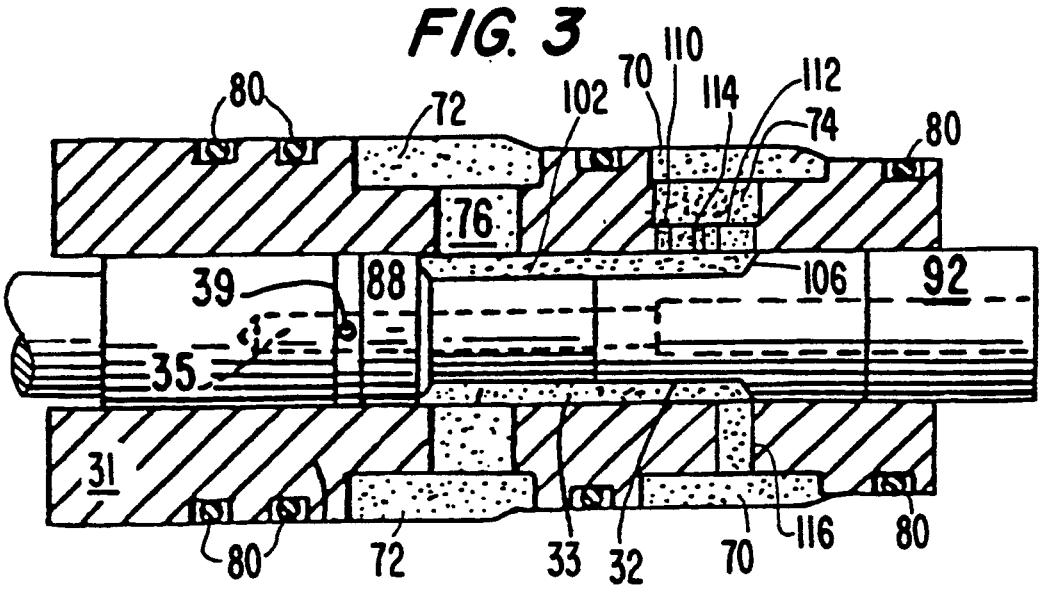
FIG. 3 is a cross-sectional view of the barrel and plunger arrangement of FIG. 2 in the fully open condition.
Figure 4:
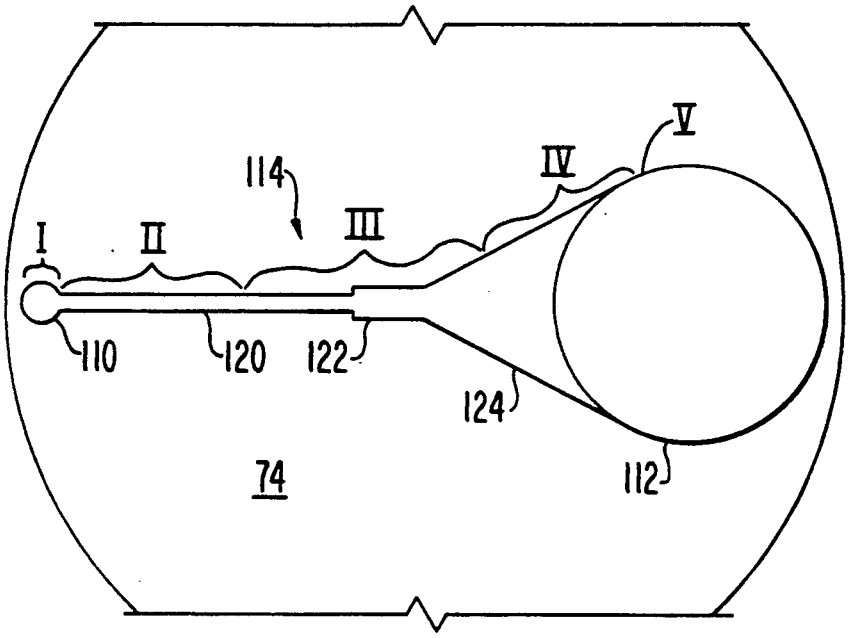
FIG. 4 is a top view of a barrel fuel inlet passage in accordance with the present invention taken along line 4—4 of FIG. 2.

Referring now to FIGS. 2 and 3, the fuel inlet passage 74 includes a first inlet port 110 and a second inlet port 112 for the passage of fuel into the central bore 33 and out the outlet passage 68. The particular configuration of the inlet ports 110 and 112, as well as the transition region 114 which extends between inlet port 110 and 112, is best illustrated in FIG. 4. Diametrically opposed to the inlet port 112 is a pressure balancing port 116 which supplies fuel to the diametrically opposed side of plunger 32 in order to balance the fuel pressure exerted on the plunger 32 which, in turn, allows for the smooth reciprocation of the plunger 32 within the barrel 23. The pressure balancing port 116 has a diameter equal to that of the inlet port 112 which is approximately 0.156 inches. The smaller inlet port 110 is of a diameter of approximately 0.030 inches, the significant of which will be discussed in greater detail hereinbelow.

Referring now to FIG. 4, as can be seen from this figure, the transition region 114 between the inlet port 110 and 112 initially begins as a narrow channel 120 having a width of approximately 0.006 inches which leads to a wider channel 122 which is of a width of approximately 0.015 inches. These channels then lead into an expansive region 124 which increases from a narrow width of 0.015 inches at the end of channel 122 and tangentially intersects the inlet port 112 as illustrated. The expansion region 124 expands at an angle which in accordance with the preferred embodiment of the invention is approximately 29 degrees. While specific values for the width of the channels 120 and 122, as well as the angle for the expansion region 124, have been set forth, these values reduce its force on the piston 34, thereby allowing the stem valve and associated structures to move toward recess 84, which gradually moves the plunger 32 to the position shown in FIG. 3. Inlet passage 74 is no longer blocked by the plunger, and an increased amount of fuel may then flow from the barrel cavity 70 into the central bore 33 and out through the outlet passage 76 to outlet bypass passage 68. The amount of fuel which reaches the cylinders is thus increased when the pressure of the air in the intake manifold increases.

The action of the dual springs 40 and 42 controls the plunger position at zero boost or "no-air" condition by adjustment of the total available spring length of the main spring 40 and bias spring 42. A boost signal, which is provided to the assembly as the air pressure in the intake manifold increases, moves the plunger 32 by working against the effective area of diaphragm 28 and the combined spring rate of main spring 40 and bias spring 42. Delay in increasing the fuel supply to the cylinders in response to increased manifold air pressure is, as a result, substantially eliminated.

The dimensions of the plunger 32 and barrel 31 of the present invention are critical to the achievement of optimum fueling metering. It has been found that forming the plunger and barrel to provide a class fit therebetween has reduced fuel leakage substantially from that encountered in other air fuel control designs. As a result, structure required to provide fuel drainage is no longer required, and the present air fuel control can be vented, preferably using existing flow passages, to the engine crankcase. The smallest interior diameter of the barrel must not exceed the largest exterior diameter of the plunger by more than 0.000075 to 0.000125 inches to provide the clearance needed for a proper class fit. Tests have indicated that leakage past a barrel and plunger having may be varied in order to provide for the optimum performance of the associated engine.

As is illustrated in FIG. 3, the plunder 32 includes a narrow stem portion 102 in a wider stop portion 92. Further, the plunger includes an angular shoulder 106. The position of the plunger shown in FIG. 3 is in the position that the plunger would occupy when the pressure of the air in the intake manifold increase sufficiently above the no-air condition which causes the plunger to move away from the air fuel cover 18. When the intake air pressure decreases during engine operation, the plunger 32 will again begin to move toward the air fuel cover 18, thus causing ports 110 and 112 to be blocked by the plunger stop portion 92. Again, as increasing air pressure moves the plunger out of contact with the inlet port 110, the shoulder 106 gradually opens this port to allow increasing amounts of fuel to flow through the central bore 33 and out the outlet passage 76.

With reference now to FIGS. 2, 3 and 4 and particularly the graphic illustration set forth in FIG. 5, the significance of the transition region 114 will be described in greater detail.

With reference initially to FIG. 2, the plunger 32 is illustrated in the position wherein the air pressure within chamber 24 is less than that required to displace the plunger 32 to the right as illustrated in FIG. 3 there by overcoming the force of compression spring 40. As described previously, it can be noted that while the inlet ports 110 and 112 as well as the transition region 114 appears to be completely sealed off, a minimal amount of fuel will bypass into the central bore region 33 and out the outlet passage 76. Once a boost force greater than that of the no-air condition acts on the piston 34, thereby displacing the plunger 32 to the right of FIG. 2 against the compression spring force 40, the plunger 32 will begin to move axially within the barrel 31. This plunger movement thus causes the plunger metering edge or shoulder 106 to open the inlet port 110 of the air fuel control barrel 31 and allow more fuel to flow through the air fuel control and out through the injectors. The amount of fuel flowing through the air fuel control is a function of boost pressure, spring rates, fuel pressure into the air fuel control and the particular shape of the inlet port in the air fuel control barrel. The amount of fuel flowing through the air fuel control is used to control the transient engine response, acceleration smoke, noise, torque below the torque peak speed, as well as the transition curve. The flow of fuel through the inlet port 110 cannot be viscosity sensitive in order to optimize engine operation for cold starts and cold accelerations.

Figure 5:
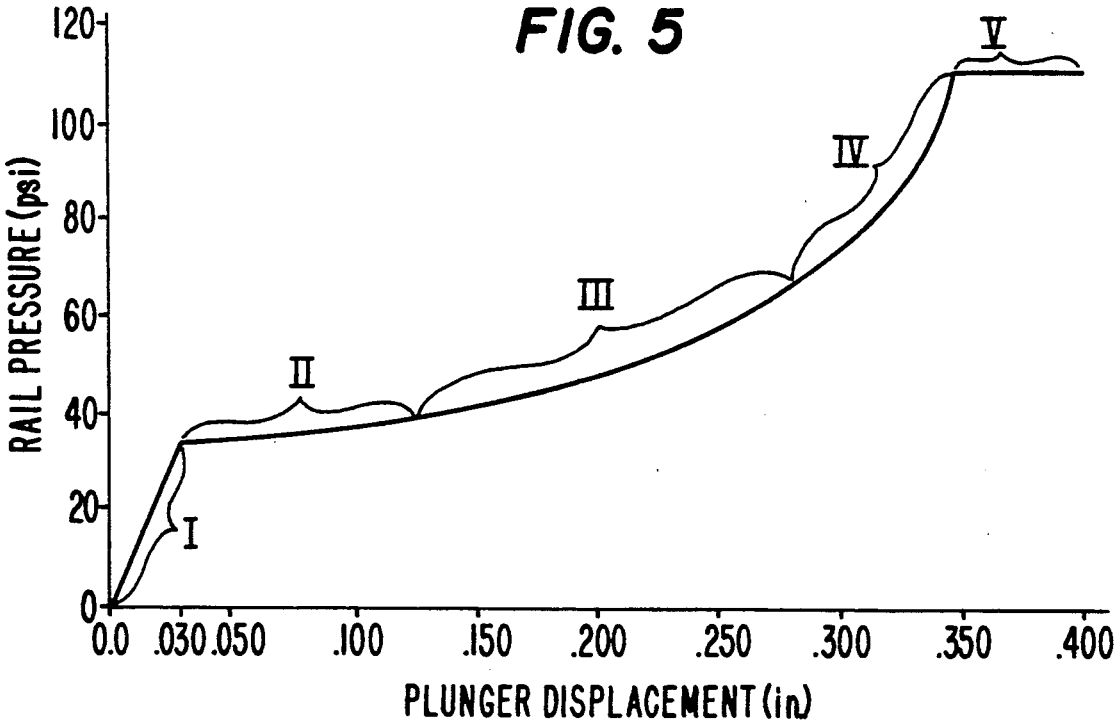
FIG. 5 is a graphical illustration of the effects of the barrel fuel inlet passage on rail pressure.

The plunger 32 is initially displaced to uncover the inlet port 110 which is graphically illustrated at the region I of FIG. 5. Due to the diameter of the inlet port 110, viscosity insensitivity is obtained at this region. As the plunger 32 continues its displacement due to an increase in air pressure in the first chamber 24, the channel 120 is uncovered. The rail pressure gradually increases as does the volume of fuel passing therethrough and it is in this region II, that the calibration of the air fuel control may be readily carried out. By continued displacement of the plunger 32, the slope of the transition curve designated by region III which takes place during the uncovering of the portion of the transition region 114 designated by III in FIG. 4 occurs. It is in this region that acceleration takes place. This region is configured so as to reduce acceleration smoke, noise and emissions while optimizing the transient engine response.

Further displacement of the plunger 32 results in an upturn in the transition curve as designated by IV which is carried out by that portion of the transition region 114 designated IV in FIG. 4. It is in this region that a driver feel of the acceleration is experienced and such can be obtained without emissions penalties because the turbocharger is now providing sufficient air to the internal combustion engine to provide for more fueling at an acceptable air fuel ratio. Once the plunger 32 has reached the inlet port 112 designated by the point V, a sharp inflection point is realized as graphically illustrated in FIG. 5 wherein full fuel flow through the inlet port is experienced.

As described previously, the present barrel and plunger assembly is designed to minimize fuel leakage between the plunger and barrel. This is achieved by controlling the pressure differential between the second chamber 26 and the barrel central bore 33 at the tip 37 of the plunger. The provision of the plunger central channel 35, the vent 39 and a conduit 122 which connects to the fuel pump housing allows the high pressure of the fuel in the central bore 33 to be reduced by the time the fuel reaches the area of the vent 39 and to be reduced further by the time the fuel reaches the second chamber 26. Fuel leakage into this cavity is therefore substantially eliminated as excess fuel is vented through vent 39 to be returned to the fuel pump through conduit 122.

Although the provisions of a barrel and plunger assembly with a class fit as described herein significantly minimized fuel leakage, a drain is required to ensure that any excess fuel which may be present is removed. The very minimal amount of fuel which might leak past the plunger is vented through internal passages in the fuel pump to the engine crank case. Consequently, a drain line 130 may be provided to serve as a fluid passage for excess fuel from the air fuel control to other conduits in the fuel pump (not shown) which drain to the engine crank case. Such a drain conduit may be located in the fuel pump cover (not shown).

While the present invention has been described with reference to a preferred embodiment, it will be appreciated by those skilled in the art that the invention may be practiced otherwise known as specifically described herein without departing from the spirit and scope of the invention. It is, therefore, to be understood that the spirit and scope of the invention be limited only by the appended claims.

INDUSTRIAL APPLICABILITY

The air fuel control of the present invention will find its primary application in an internal combustion engine of the compression ignition type wherein fuel is supplied to the engine in response to the pressure of the air intake manifold. It will be particularly useful for carefully and precisely controlling the flow of fuel to the engine cylinders in response to engine operating conditions. The present air fuel control may be effectively employed both to provide a metered flow of fuel from the fuel pump in response to increasing manifold pressure and to reduce gradually the flow of fuel from the fuel pump in response to decreasing manifold air pressure. With the abovementioned construction, the air fuel control will be insensitive to fuel viscosity, will control smoke, noise and emissions from the engine at acceleration and will optimize the transient engine response during acceleration. Furthermore, such a construction will provide an air fuel control system which will provide driver feel during acceleration once sufficient air is provided by the turbocharger to affect efficient combustion.

What is claimed is:

1. An air fuel control for an internal combustion engine having an intake manifold for supplying pressurized air to the air fuel control, said air fuel control comprising:

a housing having a central cavity formed therein, and a fuel input passage, a fuel output passage and a pressurized air passage communicating with said cavity;

a piston positioned in said cavity, a first side of said piston being in fluid contact with the pressurized air supplied through said pressurized air passage by the intake manifold;

a barrel sealingly positioned within said cavity having an axially extending central bore, a fuel input bore and a fuel output bore forming fluid communication between said fuel input passage and said central bore and said fuel output passage and said central bore respectively; and a plunger secured at a first end to a second side of said piston and reciprocably received within said central bore, said plunger including a sealing portion of a first diameter for sealing off said fuel input bore of said barrel and a reduced portion of a second diameter less than said first diameter for permitting fluid communication between said fuel input bore and said fuel output bore;

wherein said fuel input bore is configured to include a first inlet port of a first diameter, a second inlet port of a second diameter and a transition region extending therebetween so that the reciprocation of said plunger sequentially uncovers said first inlet port for supplying fuel to said engine in a manner insensitive to a viscosity of the fuel, a first portion of said transition region for supplying fuel to said engine at a low gain, a second portion of said transition region for slowly increasing the amount of fuel supplied to the engine, a third portion of said transition region for rapidly increasing the amount of fuel supplied to the engine and said second inlet port to supply a maximum amount of fuel to the engine.

2. The air fuel control as defined in claim 1, wherein said transition region includes a first channel of a predetermined width extending in a direction substantially parallel to an axial direction of said central bore from said first inlet port, a second channel of a predetermined width greater than said first channel extending substantially co-linear with said first channel, and an expansion region extending from said second channel and tangentially intersecting said second inlet port.

3. The air fuel control as defined in claim 2, further comprising a pressure balancing means for balancing the fuel pressure exerted on said plunger.

4. The air fuel control as defined in claim 3, wherein said pressure balancing means is a pressure balance bore formed in said barrel diametrically opposed to said second inlet port.

5. The air fuel control as defined in claim 4, wherein a diameter of said pressure balance bore is substantially equal to the diameter of said second inlet port

6. The air fuel control as defined in claim 1, wherein said plunger includes a shoulder formed between said sealing portion and said reduced diameter portion such that the uncovering of said inlet bore is complete when said plunger is reciprocated.

7. The air fuel control as defined in claim 1, wherein a diameter of said cavity of said barrel is 0.000075 to 0.000125 inches greater than the diameter of said sealing portion of said plunger.

8. An air fuel control for an internal combustion engine having an intake manifold for supplying pressurized air to the air fuel control, said air fuel control comprising:

a housing having a central cavity formed therein, and a fuel input passage, a fuel output passage and a pressurized air passage communicating with said cavity;

a piston positioned in said cavity, a first side of said piston being in fluid contact with the pressurized air supplied through said pressurized air passage by the intake manifold;

a barrel sealingly positioned within said cavity having an axially extending central bore, a fuel input bore and a fuel output bore forming fluid communication between said fuel input passage and said central bore and said fuel output passage and said central bore respectively; and a plunger secured at a first end to a second side of said piston and reciprocably received within said central bore, said plunger including a sealing portion of a first diameter for sealing off said fuel input bore of said barrel and a reduced portion of a second diameter less than said first diameter for permitting fluid communication between said fuel input bore and said fuel output bore;

wherein said fuel input bore is configured to include a first inlet port of a first diameter, a second inlet port of a second diameter and a transition region extending therebetween, said transition region including a first channel of a predetermined width extending in a direction substantially parallel to an axial direction of said central bore from said first inlet port, a second channel of a predetermined width greater than said first channel extending substantially co-linear with said first channel, and an expansion region extending from said second channel and tangentially intersecting said second inlet port.

9. The air fuel control as defined in claim 8, further comprising a pressure balancing means for balancing the fuel pressure exerted on said plunger.

10. The air fuel control as defined in claim 9, wherein said pressure balancing means is a pressure balance bore formed in said barrel diametrically opposed to said second inlet port.

11. The air fuel control as defined in claim 10, wherein a diameter of said pressure balance bore is substantially equal to the diameter of said second inlet port.

12. The air fuel control as defined in claim 8, wherein said plunger includes a shoulder formed between said sealing portion and said reduced diameter portion such that the uncovering of said inlet bore is complete when said plunger is reciprocated.

13. The air fuel control as defined in claim 8, wherein a diameter of said cavity of said barrel is 0.000075 to 0.000125 inches greater than the diameter of said sealing portion of said plunger.

14. A plunger and barrel assembly for a fuel supply system for an internal combustion engine, said plunger and barrel assembly comprising:

a barrel sealingly positioned within said cavity having an axially extending central bore, a fuel input bore and a fuel output bore forming fluid communication between a fuel input passage and said central bore and a fuel output passage and said central bore respectively; and a plunger reciprocably received within said central bore, said plunger including a sealing portion of a first diameter for sealing off said fuel input bore of said barrel and a reduced portion of a second diameter less than said first diameter for permitting fluid communication between said fuel input bore and said fuel output bore;

wherein said fuel input bore is configured to include a first inlet port of a first diameter, a second inlet port of a second diameter and a transition region extending therebetween, said transition region including a first channel of a predetermined width extending in a direction substantially parallel to an axial direction of said central bore from said first inlet port, a second channel of a predetermined width greater than said first channel extending substantially co-linear with said first channel, and an expansion region extending from said second channel and tangentially intersecting said second inlet port.

15. The plunger and barrel assembly as defined in claim 14, further comprising a pressure balancing means for balancing the fuel pressure exerted on said plunger.

16. The plunger and barrel assembly as defined in claim 15, wherein said pressure balancing means is a pressure balance bore formed in said barrel diametrically opposed to said second inlet port.

17. The plunger and barrel assembly as defined in claim 16, wherein a diameter of said pressure balance bore is substantially equal to the diameter of said second inlet port.

18. The plunger and barrel assembly as defined in claim 14, wherein said plunger includes a shoulder formed between said sealing portion and said reduced diameter portion such that the uncovering of said inlet bore is complete when said plunger is reciprocated.

19. The plunger and barrel assembly as defined in claim 14, wherein a diameter of said cavity of said barrel is 0.000075 to 0.000125 inches greater than the diameter of said sealing portion of said plunger.

* * * * *